United States Patent [19]

Kasuga et al.

[11] Patent Number: 4,500,199

[45] Date of Patent: Feb. 19, 1985

[54] ELECTROPHOTOGRAPHIC APPARATUS COMPRISING DETECTION ASSEMBLY FOR DETECTING RECORD PAPER SHORTAGE

[75] Inventors: Muneo Kasuga; Akira Shimizu; Tadashi Nishio, all of Hachioji, Japan

[73] Assignee: Olympus Optical Co., Ltd., Tokyo, Japan

[21] Appl. No.: 483,171

[22] Filed: Apr. 8, 1983

[30] Foreign Application Priority Data

Apr. 13, 1982 [JP] Japan ..... 57-60276

[51] Int. Cl.[3] ..... G03G 15/00

[52] U.S. Cl. ..... 355/14 CU; 355/3 SH

[58] Field of Search ..... 355/14 C, 14 SH, 3 SH, 355/14 R, 3 R, 14 CU

[56] References Cited

U.S. PATENT DOCUMENTS 4,105,914 8/1978 Murata et al. ..... 355/14 CU X 4,128,756 12/1978 Nagano et al. ..... 355/14 CU X 4,279,504 7/1981 Brown et al. ..... 355/72

*Primary Examiner*—A. C. Prescott

*Attorney, Agent, or Firm*—Fleit, Jacobson, Cohn & Price

[57] ABSTRACT

An electrophotographic apparatus of the retention type is provided with a record paper detection assembly which generates a paper shortage signal when the number of record papers stored in a paper cassette is decreased to a predetermined small number substantially equal to the number of copies which can be formed from a single latent image. When the paper shortage signal is produced during a retention copy for a document, the copying operation is completed for the current document, but further copying operation for a next document is inhibited. After the copying operation for the current document has been finished, an indication lamp is lighted to indicate that the remaining number of record papers in the cassette has been reduced to the predetermined number. Further, the copying operation for the next document which has been set on a document table can be initiated automatically after the paper cassette with a sufficient number of papers stored therein has been attached to the apparatus.

10 Claims, 5 Drawing Figures

ELECTROPHOTOGRAPHIC APPARATUS COMPRISING DETECTION ASSEMBLY FOR DETECTING RECORD PAPER SHORTAGE

BACKGROUND OF THE INVENTION

The present invention relates generally to an electrophotographic apparatus of the retention-type which can duplicate a plurality of copies of a document from a single and same electrostatic latent image once formed on a photosensitive member by a single exposure.

Such an electrophotographic apparatus of the retention-type has been known from U.S. Pat. No. 4,270,860. In this known electrophotographic apparatus, a document to be duplicated is moved with respect to a fixed exposing area and is immediately discharged from the exposing area after being exposed once. Such a document feed system is sometimes called a stream-feed system. The required number of copies are then duplicated successively from a single electrostatic latent image once formed on a photosensitive member. In such an apparatus, the document to be duplicated next can be set on the apparatus during the copying operation for the current document, and thus it is possible to perform the copying operation in an extremely efficient manner.

In this case, if the number of the record papers stored in a paper cassette is smaller than a required number of copies to be duplicated for a document, the copying operation is stopped at the time that the record paper runs out. In such an event, in order to make the remaining number of copies, the document, which has been already discharged on a document tray must be reset on the document table after inserting a sufficient number of record papers in the paper cassette. In this case, the next document, which has been already set in position during the copying operation for the first document, disturbs the additional copying operation, because this next document must be first discharged from the document table onto the document tray before the first document is reset on the document table. Therefore, there is a drawback in that if a number of documents have been previously discharged on the document tray, it is difficult to pick-up the desired document to be reset on the document table. It has been known to indicate the lack of record papers in the paper cassette. However, this could not solve the above explained problem at all, because an operator could not know the shortage of record papers before the duplicating operation.

SUMMARY OF THE INVENTION

The present invention has for its object to eliminate the drawbacks mentioned above and to provide an electrophotographic apparatus of the retention-type which is more convenient for a user.

It is another object of the invention to provide an electrophotographic apparatus of the retention-type in which a shortage of record papers can be predicted before starting a duplicating operation.

According to the invention, in an electrophotographic apparatus of the retention-type for forming a plurality of duplicated copies from a single latent image of a document, the apparatus comprising a photosensitive member, said photosensitive member being movably arranged; means for substantially uniformly charging said photosensitive member; means for projecting an optical image of the document to be duplicated onto the uniformly charged photosensitive member so as to form an electrostatic latent image thereon corresponding to the document; means for developing the electrostatic latent image with toner particles to form a toner image; means for transferring the developed toner image onto a record paper at a transfer section; means for feeding the record paper through the transfer section; and means for fixing the transferred toner image to form a duplicated copy;

means for detecting the number of remaining record papers in a paper supplying means; and means for producing a paper shortage signal when the number of remaining record papers is decreased to a predetermined number slightly larger than the maximum number of duplicated copies which can be formed from a single latent image.

DESCRIPTION OF THE PREFERRED EMBODIMENTS

Figure 1:
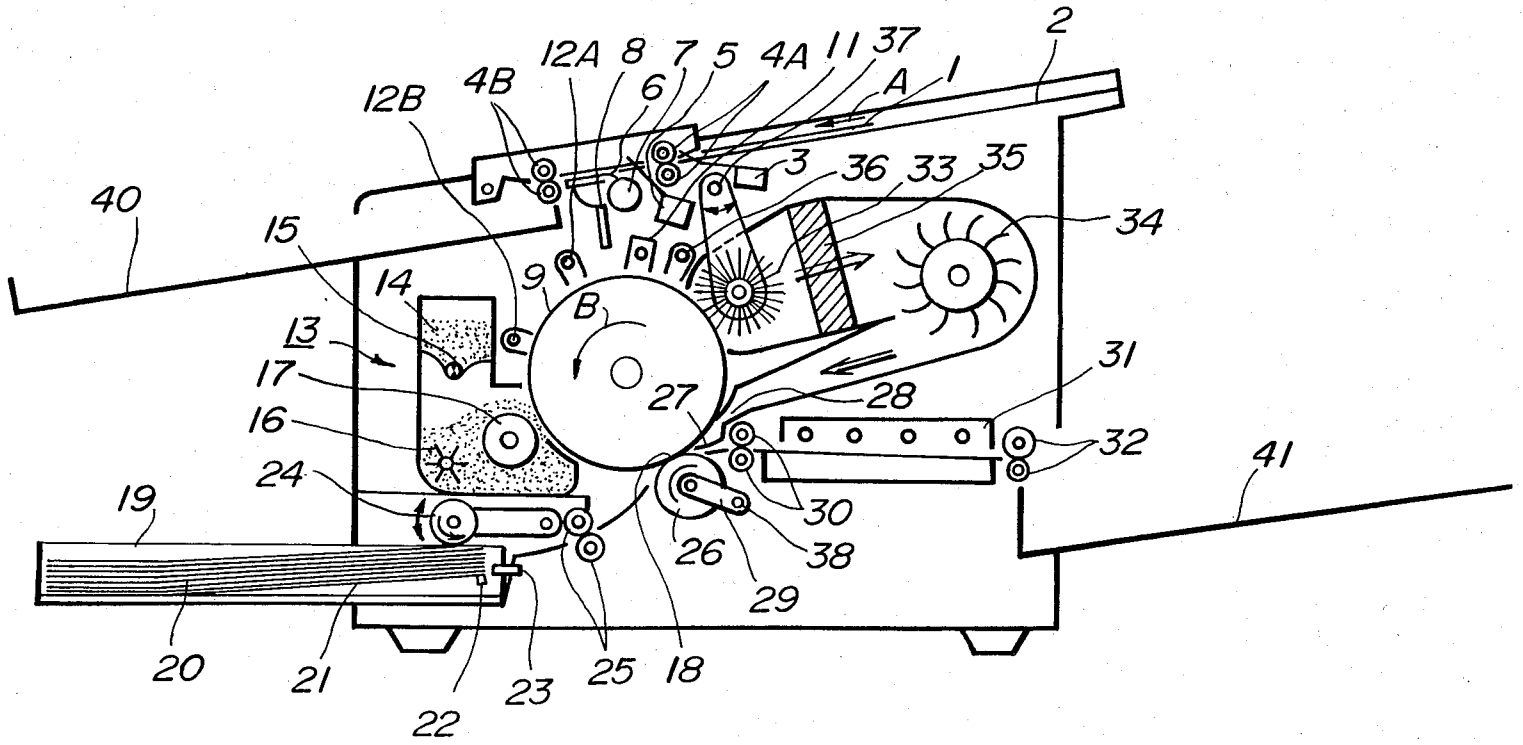
FIG. 1 is a schematic view showing the interior structure of one embodiment of electrophotographic apparatus according to the invention.

FIG. 1 is a schematic view illustrating the interior construction of an electrophotographic apparatus according to the invention. First of all a document 1 to be duplicated is inserted along a document table 2 from the right hand side in FIG. 1 as shown by an arrow A. The front edge of the document 1 is detected by a first document detecting microswitch 3 having an actuator extending into the document feed path so as to drive two pairs of document feed rollers 4A and 4B. Then the document is advanced while being clamped between the first pair of feed rollers 4A. While the document 1 advances in the direction A, its front edge is detected by a second document detection microswitch 5 so as to produce a document detection signal which will be used as a basic or start signal for further sequential control. But it should be noted that any other signal than said document detection signal may be used as the basic signal for controlling various timings. The document 1 is further fed onto a transparent plate 6 at which it is exposed by an elongated light source 7. The image of the exposed document 1 is projected by means of an array 8 of the optical fibers of converging type onto the surface of a photosensitive drum 9. The array 8 is aligned in a direction parallel to the width of the document 1.

The drum 9 comprises a photosensitive layer such as an Se layer, and is rotated by a main motor (not shown) through a clutch in a counter-clockwise direction, shown by arrow B, and at a given peripheral velocity which is equal to the feeding speed of the document 1. The photosensitive layer has been uniformly charged in the positive polarity by a corona charger 11. Therefore, an electrostatic charge latent image corresponding to the image of the document 1 is formed on the drum 9. Unnecessary charge on the area of the drum surface on which no document image is formed is erased by lateral and longitudinal trimming lamps 12A and 12B. These lamps also serve to erase undesired charge on the drum surface which will be deposited by a transferring roller in case of forming a plurality of copies from the single latent image, which will be explained later. The electrostatic latent image is developed with toner particles by a developing device 13. In this embodiment, the developing device 13 comprises a toner reservoir 14, a knurled roller 15 for supplying a given amount of toner particles from the toner reservoir, an agitating vane 16 for mixing the toner particles with magnetic carriers, and a magnet roller 17 for forming a toner brush. Such a developing device 13 per se has been well known as a magnetic brush developing device. The toner image thus formed on the drum 9 is then transferred onto a record paper 20 at a transferring section 18.

As will be described hereinafter in detail, the record papers 20 stored in a paper cassette 19 are constantly pressed upward by a leaf spring 21 arranged in cassette 19, and the uppermost paper is urged against peeling claws (not shown). Moreover, a magnet 22 is fixed to a movable end of the leaf spring 21 so as to be opposite to a magnetic sensing element, such as a Hall-IC 23 secured to the main body, when the number of the record papers in the cassette 19 is decreased to a predetermined number.

The record paper 20 is supplied from the paper cassette 19 by means of a pick-up roller 24 rotatably supported by a swingable arm and a pair of register rollers 25 which are driven in synchronism with the rotation of the drum 9 by means of a magnetically operating clutch (not shown). The transfer is carried out by means of a transfer roller 26. In order to effect the transfer without deteriorating the latent image on the drum 9 it is preferable to apply a transfer bias voltage of 400–600 volts to the transfer roller 26, which is made of resilient material having high resistivity. The record paper 20 having the toner image transferred thereon is then separated from the drum surface by means of a pair of peeling claws 27 arranged at both edges of the drum 9, and an air stream supplied through a duct 28 also serves to separate the paper 20 from the drum 9. The record paper 20 is then fed along a guide plate and is further advanced by a pair of feeding rollers 30 into a fixing device 31 of an oven heater type. After the toner image has been fixed onto the paper, the final duplicated copy is discharged on a copy discharge tray 41 by means of a pair of feeding rollers 32.

When it is not intended to print a plurality of copies from the same and single latent image, residual toners on the drum surface are removed by a rotating cleaning brush 33. Then the toners are sucked by an air stream caused by a fan 34 directly coupled to the main motor and are collected by a filter 35. In this embodiment the fan 34 is used to produce the air stream for peeling the paper from the drum 9. Then the electrostatic charge latent image is erased by an erasing lamp 36. In this manner the preparation for the next duplicating step has been completed.

On the other hand when a plurality of copies are to be formed from the same and single latent image once formed on the drum 9, the cleaning brush 33 is swingably moved away from the drum 9 about an axis 37 so as not to remove the residual toners on the drum 9 in order not to deteriorate the latent image. It is to be understood that the erasing lamp 36 should not be on during multiple duplication. By repeating the developing and transferring steps successively for the same latent image, it is possible to form the visible toner images on successively supplied record papers so as to obtain a desired number of duplicated copies.

In the above explanation it is assumed that the record papers 20 are fed in a correct manner without any difficulty. But when the paper is jammed on its travelling path, this event should be detected in order to stop the duplicating operation. At the same time it is necessary to separate the transfer roller 26 from the drum 9 so as to make it easy to remove the jammed paper. To this end the transfer roller 26 is rotatably supported by an arm 29 which is moved swingably about a shaft 38 by energizing a pair of solenoids.

Figure 2:
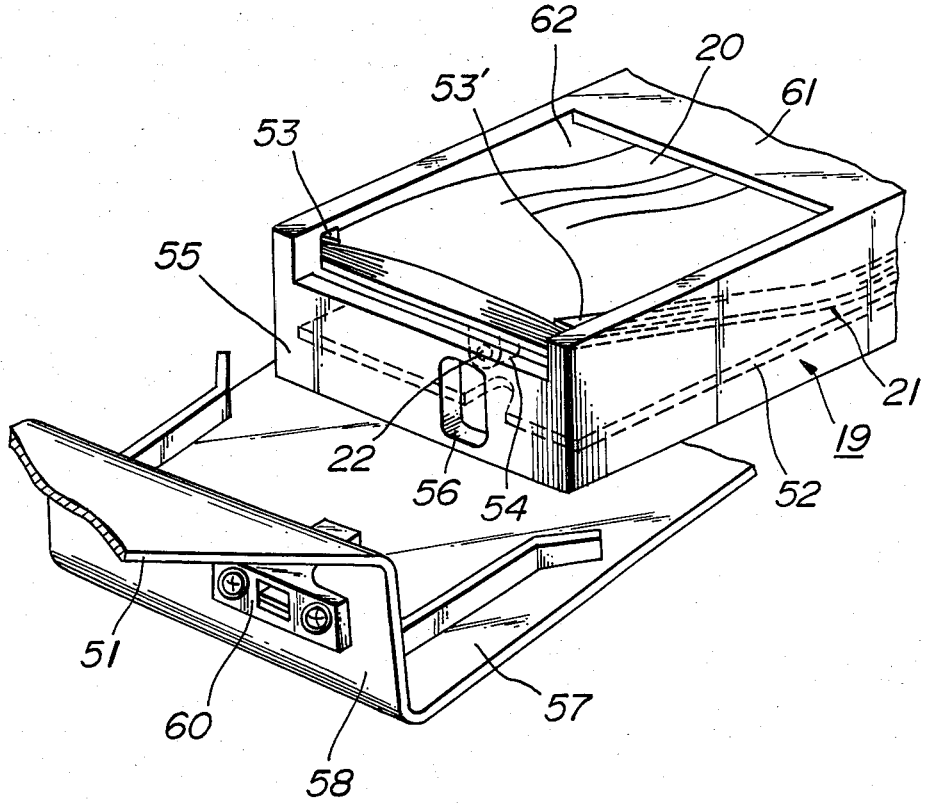
FIG. 2 is a perspective view illustrating one embodiment of a cassette fitting portion and a paper cassette according to the invention.
Figure 3:
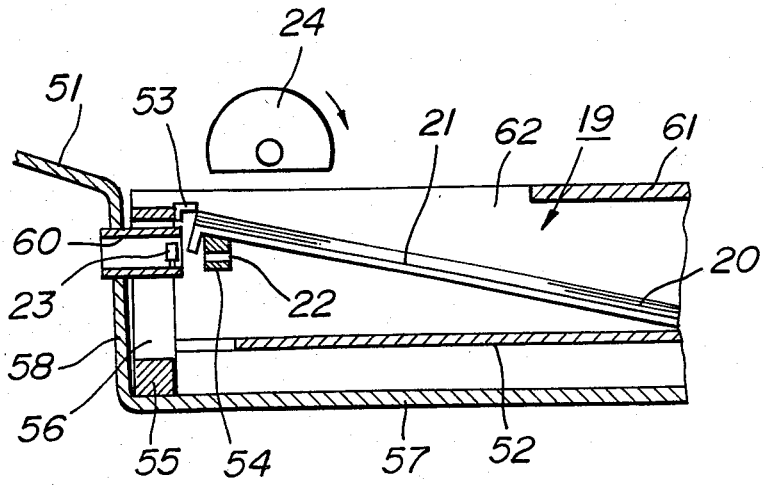
FIG. 3 is a cross-sectional view depicting the condition wherein the paper cassette is attached to the cassette fitting portion.

FIG. 2 is a perspective view showing one embodiment of the paper cassette 19 and a cassette fitting portion of the main body 51 of the apparatus, and FIG. 3 is a cross-sectional view illustrating the condition that the paper cassette is attached to the cassette fitting portion. As explained above, the paper cassette 19 comprises a middle plate 21 constructed of a leaf spring, one end of which is secured to a base plate 52, and the middle plate 21 is energized upwardly by the elastic force thereof to press the record papers 20 against a pair of peeling claws 53 and 53'. Moreover, a magnet holder 54 holding the magnet 22 is fixedly arranged to the movable end of the middle plate 21, and an elongated hole 56 whose hole length is equal to a movable distance of the magnet 22 is formed in a front wall 55 of the paper cassette 19.

Furthermore, a Hall-IC holder 60 is secured to an upright portion 58 integrally formed with a bottom plate 57 of the main body 51 at a position corresponding to the elongated hole 56. When the paper cassette 19 is attached to the cassette fitting portion, the Hall-IC 23 fixed to the Hall-IC holder 60 is inserted into the elongated hole 56. This is to say, as shown in FIG. 3, when the paper cassette 19 is fitted into the main body, the Hall-IC 23 is inserted into the paper cassette 19 through the hole 56 formed in the front wall 55 so as to be opposed to the magnet 22. Moreover, an opening 62 is formed in the upper cover 61 of the paper cassette 19 to successively feed the sheets 20 by the pick-up roller 24.

In the embodiment described above, when the number of the record papers 20 stored in the cassette 19 is decreased, the movable end of the leaf spring 21 is moved upward due to the elastic force thereof, and thus the magnet 22 is moved toward the Hall-IC 23. Therefore, when a large number of the record papers remain in the paper cassette, the magnet 22 is apart from the Hall-IC 23 and the Hall-IC 23 remains in an OFF state. On the other hand, if the number of the record papers 20 is decreased up to the predetermined number, the Hall-IC 23 changes into an ON state. The predetermined number can be set at will by adjusting a positional relation between the Hall-IC 23 and the magnet 22. In the present embodiment, the predetermined number is set at a little larger number than the maximum number duplicatable by a single exposure.

For example, if it is assumed that the maximum number duplicatable by a single exposure is twenty sheets, it is preferable that the Hall-IC 23 is made ON when the remaining number of the record papers in the paper cassette becomes twenty-five to thirty. That is to say, even if the number of record papers stored in the paper cassette 19 is decreased gradually and the Hall-IC 23 is made ON after setting the number to be duplicated at twenty sheets, about twenty-five to thirty sheets of record papers still remain in the paper cassette, so that it is possible to eliminate the drawback that the record paper cassette 19 becomes empty during the copying operation. Moreover, in this case, after the current copying operation has been finished completely, the copying operation for the next document is not started till new record papers are supplied to the paper cassette. Therefore, in the embodiment according to the invention, it is possible to eliminate the condition wherein the document to be duplicated must be reset due to the lack of record paper in the cassette during the copying operation for the relevant document.

Furthermore, if the present invention is applied to the electrophotographic apparatus of the stream-feed type disclosed in U.S. Pat. No. 4,270,860, it is possible to easily distinguish an un-copied document from those whose duplication have been finished, because the document which is not yet duplicated is maintained on the document table till the copying operation for the current document is normally ended.

Figure 4:
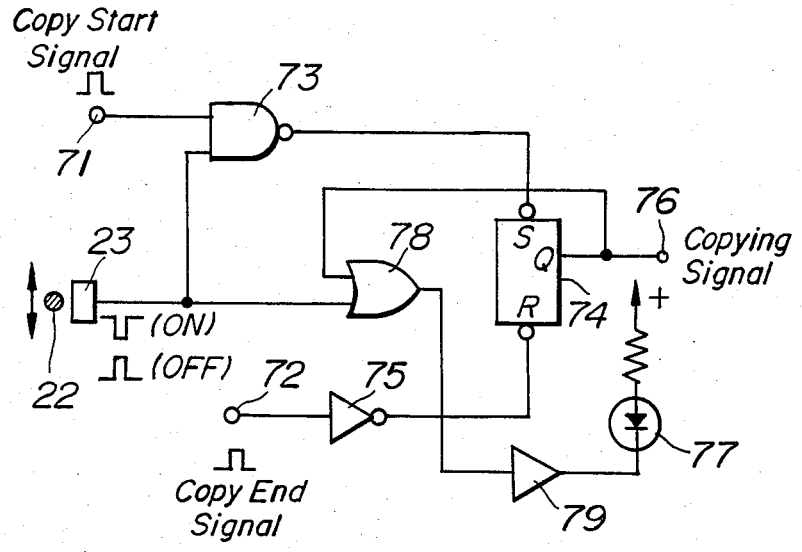
FIG. 4 is a block diagram showing one embodiment of a signal processing circuit according to the invention.

FIG. 4 is a block diagram showing one embodiment of a signal processing circuit according to the invention. A copy start signal occurs when the second document detecting switch 5 shown in FIG. 1 detects the document 1, and the detection signal supplied to an input terminal 71 as the copy start signal having a high level. Moreover, a copy end signal is generated when the copying operation is ended, and is supplied to an input terminal 72 as the copy end signal having a high level. The Hall-IC 23 is made ON and generates a low level signal when the record papers in the paper cassette 19 are gradually decreased and the remaining number of record papers is equal to the predetermined number. When a large number of record papers are supplied into the paper cassette, the Hall-IC 23 generates a high level signal.

If, a sufficient number of record papers are in the paper cassette when the copy start signal is supplied to the input terminal 71, the output of a NAND gate 73 is a low level pulse and this low level pulse is supplied to a set terminal of a flip-flop 74. During the copying operation, no copy end signal is supplied to the input terminal 72. Therefore, the output level of a NOT gate 75 is maintained at a high level and a flip-flop 74 is made ON, and thus its non-inverting output Q becomes a high level signal during the copying operation. Then, this high level signal is derived from output terminal 76 as a copying signal which is further used to control the electrophotographic apparatus. Moreover, if the level of the copying signal becomes too low, the copying operation is stopped.

Usually, when the copying operation is ended, the copy end signal is supplied to the gate 75 through the input terminal 72 and the output of the gate 75 becomes a low level pulse. Then, this low level pulse is supplied to the reset terminal of the flip-flop 74 and thus the flip-flop 74 is made OFF to end the copying operation. Moreover, when setting the next document to be duplicated on the document table, since the copy start signal for this document is generated, the flip-flop 74 generates the copying signal again and thus the copying operation for the next document can be performed successively.

Contrary to this, when during the copying operation the number of record papers in the paper cassette 19 is decreased and the Hall-IC 23 is made ON, the output of the Hall-IC 23 becomes low level to produce the paper shortage signal. In this case, even if the copy start signal for the next document is supplied, the copying operation for the next document is prevented by means of the NAND gate 73. That is to say, the copying operation for the current document is performed completely so that the required number of copies can be duplicated, but the copying operation for the next document is inhibited.

In the embodiment shown in FIG. 4, a paper supply indicating lamp 77 is switched on under the control of an OR gate 78 and a gate 79. To the OR gate 78 are supplied the output of the Hall-IC 23 and the copying signal derived from the Q terminal of flip-flop 74. Therefore, since the output of the OR gate 78 is at a high level even if the Hall-IC 23 is made ON and produces the paper shortage signal, the output of the gate 79 is maintained at a high level and thus the paper supply indicating lamp 77 is not on. When the copying operation for the current document is finished, the copying signal derived from the Q terminal of the flip-flop 74 becomes low level and thus the outputs of the OR gate 78 and the gate 79 become low level so that the paper supply indicating lamp 77 is switched on. That is to say, in the embodiment mentioned above, even if the number of record papers in the cassette decreases to the predetermined number and the Hall-IC 23 produces the paper shortage signal during the copying operation, a switching-on timing of the paper supply indicating lamp 77 is delayed till the copying operation for the current document is completely ended. The next document previously set on the document table may be maintained as it is or may be discharged from the table.

Figure 5:
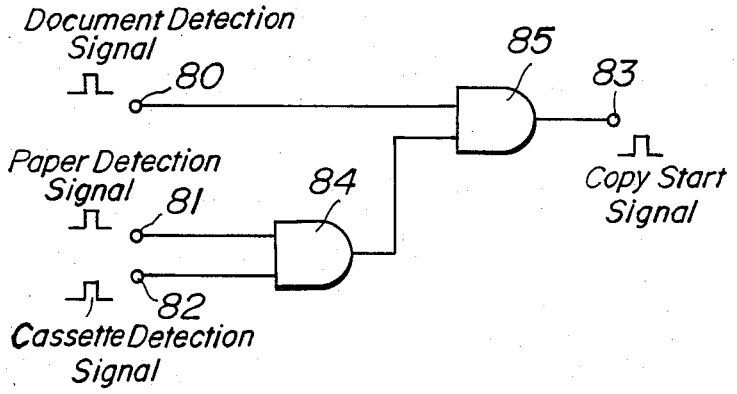
FIG. 5 is a block diagram illustrating one embodiment of a signal processing circuit for automatically starting the copying operation after the paper supplying operation is ended.

FIG. 5 is a block diagram showing one embodiment of a signal processing circuit for automatically starting a copying operation after new record papers have been set in the cassette. In the embodiment shown in FIG. 5, it is assumed that the next document to be duplicated is maintained on the document table. Therefore, the second document detecting switch shown in FIG. 1 is made ON and thus the document detection signal supplied to input terminal 80 is at a high level. Moreover, since the magnet 22 is spaced from the Hall-IC 23 after the paper supplying operation, the paper detection signal supplied from the Hall-IC 23 to input terminal 81 is at a high level state. Furthermore, a cassette detecting signal supplied to input terminal 82 also is at a high level when the paper cassette 19 is attached precisely to the main body. When these three signals are generated at the same time, each output of AND gates 84, 85 is at a high level. Therefore, if the output derived from the AND gate 85 is used as a copy start signal to control the electrophotographic apparatus, it is possible to perform automatically the copying operation for the next document in succession.

As clearly understood from the above, in an electrophotographic apparatus of the retention-type which can form a plurality of duplicated copies by a single exposure, since the paper shortage signal is generated when the number of record papers in the cassette is decreased to a predetermined number slightly larger than the maximum number duplicatable by a single exposure, a record paper shortage does not occur during the copying operation even if the paper shortage signal occurs during the copying operation for the current document. Moreover, since the copying operation for the next document is not effected once the paper shortage signal has been generated during the copying operation for the current document, it is possible to eliminate the cumbersome operation of resetting the document and to improve the operation of the electrophotographic apparatus. Further, according to the invention, it is possible to eliminate an unnecessary burden for the user of the electrophotographic apparatus.

The present invention is not limited to the embodiments mentioned above, but various alterations and modifications are possible. For example, in the embodiment mentioned above, the copying operation for a new document is always prevented after the paper shortage signal has been generated, but the electrophotographic apparatus may be constructed such that a single copy for a new document can be effected until the paper cassette becomes empty. However, in this case, it is preferable to arrange another detecting apparatus for detecting a complete absence of the record paper, but it is possible to use the record paper effectively.

What is claimed is:

1. An electrophotographic apparatus of the retention-type for forming a plurality of duplicated copies from a single latent image of a document, the apparatus comprising:

a photosensitive member, said photosensitive member being movably arranged;

means for substantially uniformly charging said photosensitive member;

means for projecting an optical image of the document to be duplicated onto the uniformly charged photosensitive member so as to form an electrostatic latent image thereon corresponding to the document;

means for developing the electrostatic latent image with toner particles to form a toner image;

means for transferring the developed toner image onto a record paper at a transfer section;

means for feeding the record paper through the transfer section; and means for fixing the transferred toner image to form a duplicated copy;

means for detecting the number of remaining record papers in a paper supplying means; and means for producing a paper shortage signal when the number of remaining record papers is decreased to a predetermined number slightly larger than the maximum number of duplicated copies which can be formed from a single latent image.

2. An apparatus according to claim 1, further comprising means for responding to said paper shortage signal to complete the duplicating operation for a current document, and for inhibiting the start of a duplicating operation for a next document.

3. An electrophotographic apparatus according to claim 1, further comprising means for keeping the next document to be duplicated on a document table when the paper shortage signal is generated during the copying operation for the current document.

4. An apparatus according to claim 2, wherein said means for responding to said paper shortage signal comprises means for generating a paper supply indicating signal after the duplicating operation for the current document has been finished and an indicator for responding to said paper supply indicating signal to generate an indication.

5. An apparatus according to claim 4, wherein said means for responding to the paper shortage signal comprises a first input terminal for receiving a copy start signal, a second input terminal connected to an output of said detecting means and a third input terminal for receiving a copy end signal, a NAND gate having inputs connected to said first and second input terminals, a flip-flop having a set input connected to an output of the NAND gate and a reset input connected to said third input terminal, and an output terminal connected to an output of said flip-flop for producing a signal which allows or inhibits the duplicating operation.

6. An apparatus according to claim 5, wherein said means for responding to the paper shortage signal further comprises an OR gate having inputs connected to said second input terminal and the output of said flip-flop, and an indicator for indicating the paper shortage in response to the paper shortage signal after the duplicating operation for the current document has been finished.

7. An apparatus according to claim 1, further comprising means for generating a copy start signal after the paper supplying means having new papers stored therein has been set in the electrophotographic apparatus so as to start automatically the duplicating operation for the next document.

8. An apparatus according to claim 7, wherein said copy start signal generating means comprises a first input terminal for receiving a document detection signal, a second input terminal for receiving the paper shortage signal, a third input terminal for receiving a paper supplying means detection signal, a first AND gate having inputs connected to said second and third input terminals and a second AND gate having inputs connected to said first input terminal and to an output of said first AND gate and an output for providing the copy start signal.

9. An apparatus according to claim 1, wherein said detecting means comprises a magnet secured to a plate of the paper supplying means, said plate supporting the record papers and being moved in accordance with the number of remaining record papers stored in the paper cassette; and a Hall-IC arranged on a main body of the electrophotographic apparatus at a paper-supplying means fitting position for producing said paper shortage signal when said magnet is opposed to said Hall-IC.

10. An apparatus according to claim 3, wherein said predetermined number is made adjustable by changing the positional relation between said magnet and Hall-IC.

* * * * *